US005779614A

United States Patent [19]

Kurtz

[11] Patent Number: 5,779,614

[45] Date of Patent: Jul. 14, 1998

[54] METHOD AND APPARATUS FOR FOLDING TOY BALLOONS

[75] Inventor: Richard John Kurtz, Arvada, Colo.

[73] Assignee: M & D Balloons, Inc., Manteno, Ill.

[21] Appl. No.: 523,235

[22] Filed: Sep. 5, 1995

[51] Int. Cl.[6] ..... B31B 1/26

[52] U.S. Cl. ..... 493/436; 493/447; 493/418; 493/450

[58] Field of Search ..... 493/256, 179, 493/180, 162, 181, 182, 201, 243, 276, 436, 10, 13 A, 23, 25, 313, 395, 405, 460, 417, 418, 437, 438, 441, 444, 446, 447, 448, 449, 450, 455, 456, 457, 461, 476, 458, 955, 959, 968; 198/689.1

[56] References Cited

U.S. PATENT DOCUMENTS

| | | | |
|---|---|---|---|
| 2,834,595 | 5/1958 | Gilchrist | 493/23 |
| 3,803,798 | 4/1974 | Clancy | 53/120 |
| 3,927,875 | 12/1975 | Winnemoller | 493/418 |
| 3,973,373 | 8/1976 | Williams | 53/120 |
| 4,022,457 | 5/1977 | Marin | 493/441 |
| 4,041,849 | 8/1977 | Tsukasaki | 493/436 |
| 4,084,391 | 4/1978 | Williams | 53/120 |
| 4,273,550 | 6/1981 | Kamp | 493/256 |
| 4,548,595 | 10/1985 | Heater | 493/458 |
| 4,614,512 | 9/1986 | Capdeboscq | 493/441 |
| 5,094,658 | 3/1992 | Smithe | 493/248 |

*Primary Examiner*—Scott A. Smith
*Assistant Examiner*—Christopher W. Day
*Attorney, Agent, or Firm*—Fitch, Even, Tabin & Flannery

[57] ABSTRACT

An arrangement is provided for the automatic folding of toy balloons. A series of folding plates are provided along a path of travel and a vacuum conveyor provides traction force for the balloon as it slides across the folding plates. The folding plates interfere with the path of travel of the balloon causing the balloon to fold side-to-side. Tucking blades fold the balloon lengthwise to complete the folding operation.

21 Claims, 17 Drawing Sheets

METHOD AND APPARATUS FOR FOLDING TOY BALLOONS

BACKGROUND OF THE INVENTION

1. Field of the Invention

The present invention pertains to manufacturing and packaging techniques for toy balloons.

2. Description of the Related Art

Toy balloons come in a variety of different sizes and shapes, and, further, are printed to display different graphic designs and messages. It has become popular to present a number of toy balloons to a recipient on special occasions, with the balloons having different appropriate messages. A sales location for such balloons (and even more so, distributors for such balloons) must deal with the packaging and storage of a large number of balloon items. If a large number of identical balloons are inventoried, they could be stored in appropriate sized bulk containers. However, many sales locations, such as floral shops and greeting card stores, might find that they would prefer to stock a few examples of each product item, rather than maintain an inventory of bulk packages for each product item.

As mentioned above, it has become customary to present a number of balloons to a recipient. Balloon distributors, sales locations are others involved in manufacturing and distribution of toy balloons may find it convenient to present packaged products to a consumer, containing a preselected variety of balloons bearing appropriate messages and designs. The balloons chosen for a particular package, for example, could be selected by a graphics artist or other trained professional so that the ultimate recipient of the balloons is presented with a coherent visual image. For example, the balloons selected for a product package could be preselected for color matching and for other aesthetic considerations such as size and shape. Similarities can be seen in similar but unrelated industries. For example, flowers are typically sold in preselected floral arrangements which are prepared by trained personnel to present a product having enhanced aesthetic appeal. The prepackaging of balloons would allow the balloon industry to present its consumers with preselected, attractive balloon arrangements, invoking consumer experience with floral arrangements and other choice-selecting skills in their sales promotions.

SUMMARY OF THE INVENTION

It is an object of the present invention to provide techniques for presenting balloons in packages.

Another object of the present invention is to provide techniques for folding balloons preparatory to their packaging.

A further object of the present invention is to provide a readily reconfigurable folding apparatus for folding toy balloons, which can accommodate a wide variety of balloons having different size and shape.

These and other objects according to the present invention are provided in an apparatus for folding a deflated toy balloon comprising at least two balloon films joined together at their peripheral edges to form a pressure-containing vessel, comprising:

a conveyor means extending along a path of travel, having an inlet end and an outlet end, for engaging a first portion of the toy balloon, for hangingly suspending a second portion of the toy balloon and for conveying the toy balloon along the path;

a folding plate disposed along the path, at least partly below the conveyor means, having an inlet edge with a working edge portion disposed at an angle to the conveyor means; and the conveyor means conveying the toy balloon past the folding plate so as to slide the second portion of the toy balloon in overlying relationship with the inlet edge of the folding plate, deflecting the second portion of the toy balloon between the folding plate and the conveyor means, folding the second portion of the toy balloon in overlying relationship with the first portion of the toy balloon.

Other objects of the present invention are attained in a method for folding a deflated toy balloon comprising at least two balloon films joined together at their peripheral edges to form a pressure-containing vessel, comprising the steps of:

providing a conveyor means extending along a path of travel, the conveyor means having an inlet end and an outlet end;

engaging a first portion of the toy balloon, and hangingly suspending a second portion of the toy balloon while conveying the toy balloon along the path of travel;

providing a folding plate having an inlet edge with a working edge portion;

disposing the folding plate along the path of travel, at least partly below the conveyor means and at an angle to the conveyor means; and conveying the toy balloon past the folding plate so as to slide the second portion of the toy balloon in overlying relationship with the inlet edge of the folding plate, deflecting the second portion of the toy balloon between the folding plate and the conveyor means, and folding the second portion of the toy balloon in overlying relationship with the first portion of the toy balloon.

DETAILED DESCRIPTION OF THE PREFERRED EMBODIMENT

Figure 1:
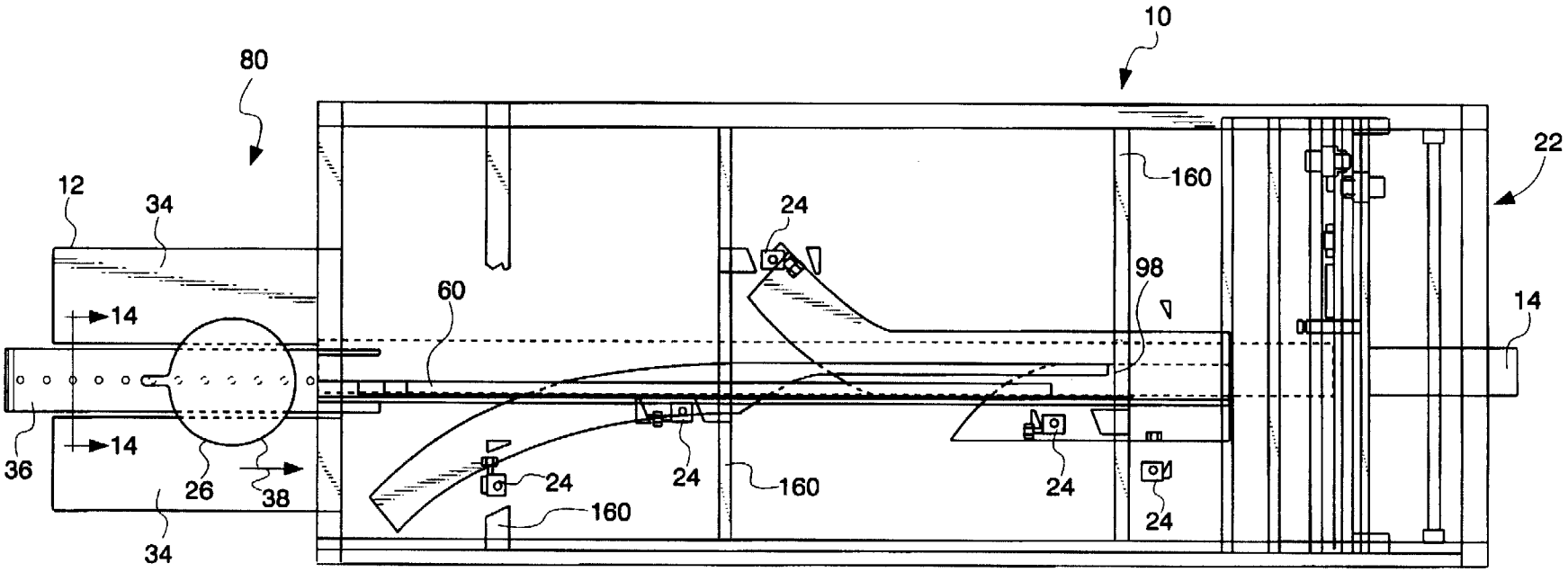
FIG. 1 is a top plan view of balloon folding apparatus according to principles of the present invention.
Figure 2:
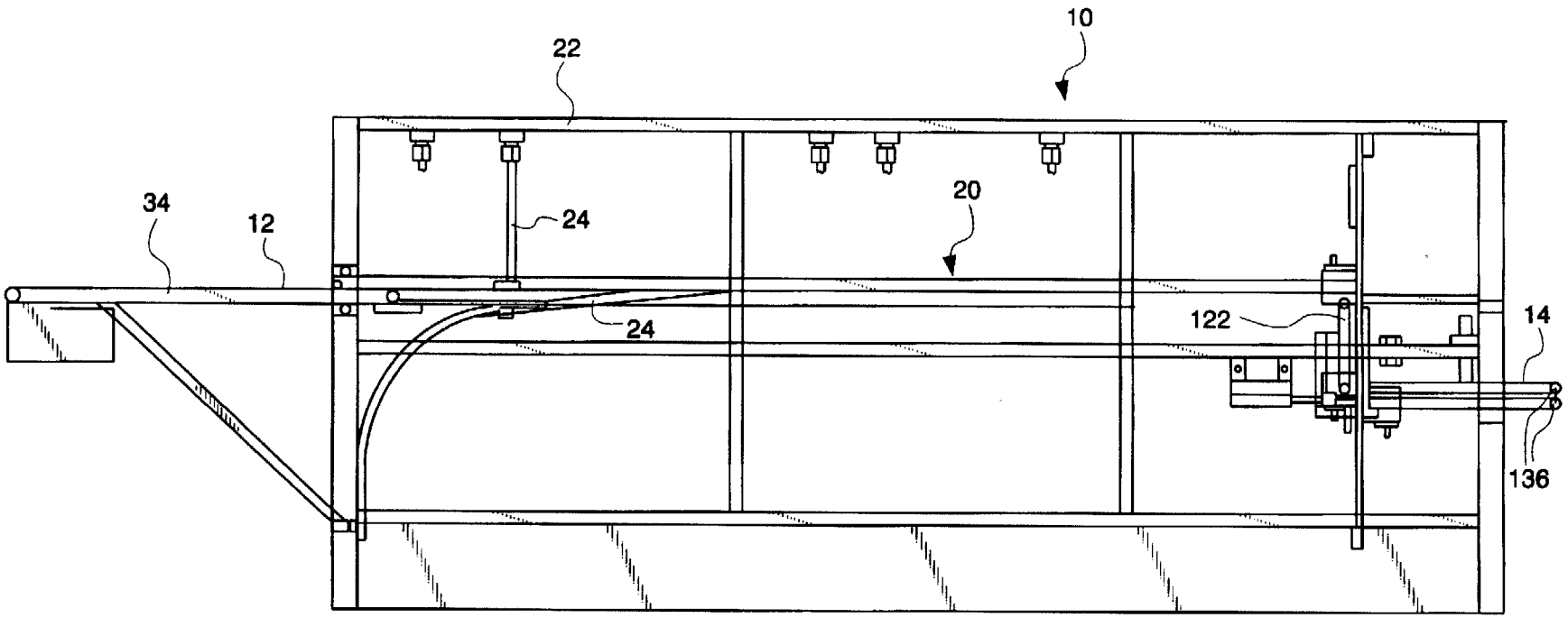
FIG. 2 is a side elevational view thereof.
Figure 30:
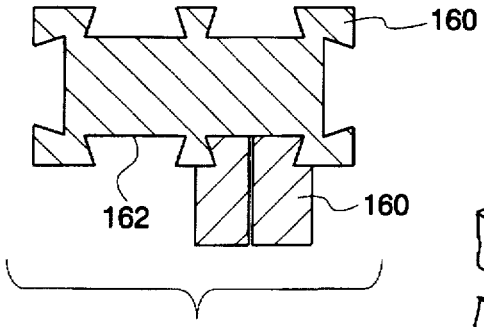
FIG. 30 is a cross-sectional view taken along the line 30—30 of FIG. 29.

Referring now to the drawings, and initially to FIGS. 1 and 2, a balloon folder is generally indicated at 10. The balloon folder includes an entrance end 12 at which unfolded balloons are fed into the machine, and an exit end 14 at which folded balloons emerge. A conveyor generally indicated at 20 is suspended from a framework 22. A number of folding plates are suspended from framework 22 by articulated hangers 24 of the type shown in FIGS. 29 and 30, as will be seen herein.

Figure 3:
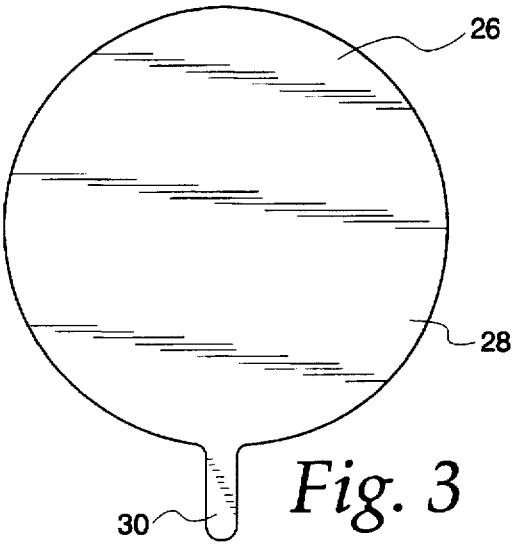
FIG. 3 is a top plan view of a toy balloon in an unfolded condition.
Figure 4:
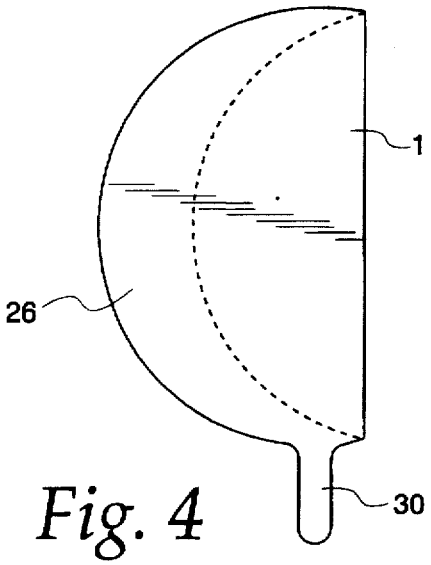
FIGS. 4–8 show a sequence of folding steps performed on the balloon of FIG. 3.
Figure 5:
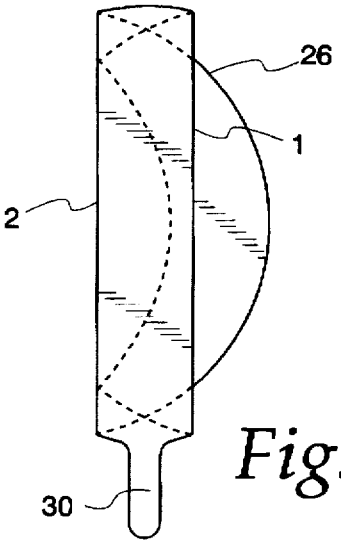
Figure 8:
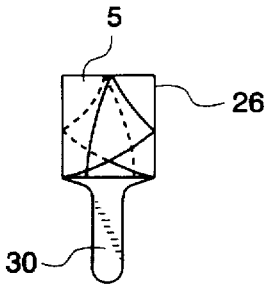
Figure 11:
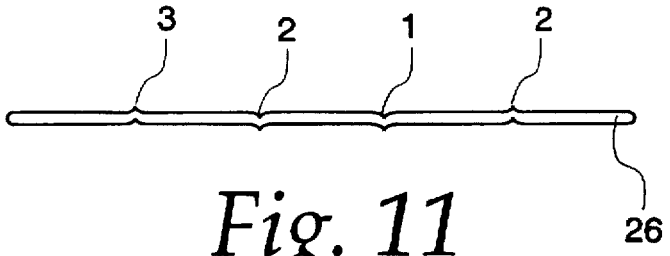
FIG. 11 is an end elevational view thereof.
Figure 9:
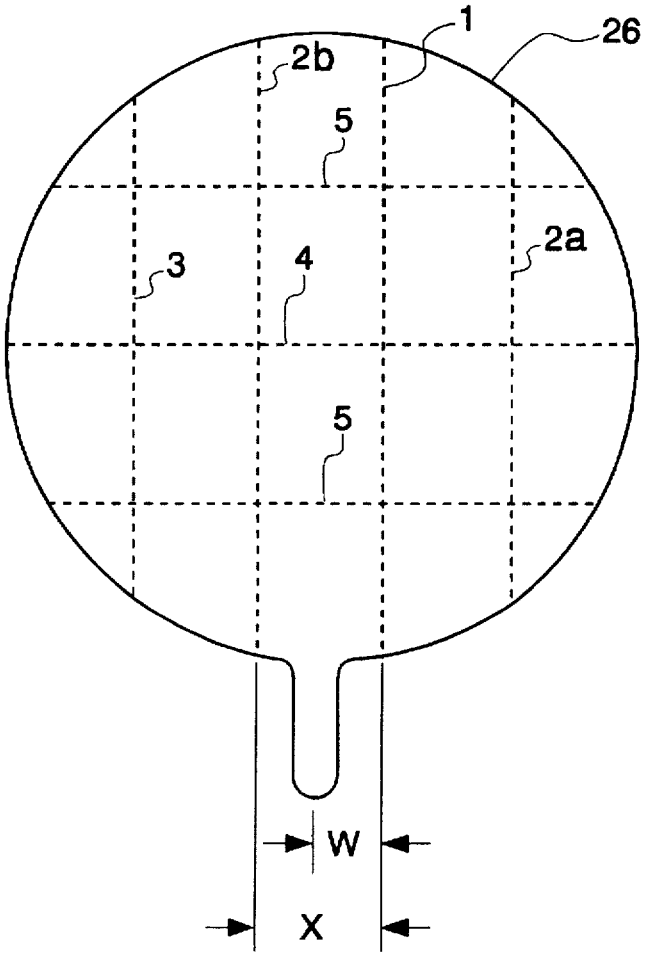
FIG. 9 shows the balloon of FIG. 3 which has been folded and subsequently unfolded, leaving fold lines in the balloon films.
Figure 10:
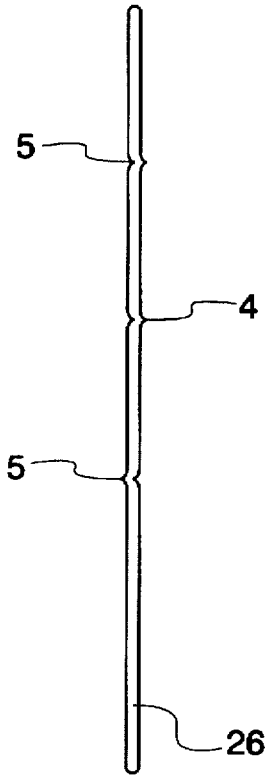
FIG. 10 is a side elevational view thereof.

A brief overview of the method and apparatus will now be given. Referring initially to FIG. 3, a toy balloon 26 includes a generally circular body part 28 and a neck portion 30. As will be seen, the present invention can be used with other shapes of film objects, such as heart-shaped and star-shaped balloons. As shown in FIGS. 4–9, balloon 26 is folded five times, along fold lines 1–5. FIG. 8 shows the balloon in a fully folded configuration, and FIG. 9 shows the folded balloon after it has been unfolded, with the fold lines indicated by dotted lines. FIGS. 10 and 11 show the direction of folding of the fold lines 1–5.

Figure 12:
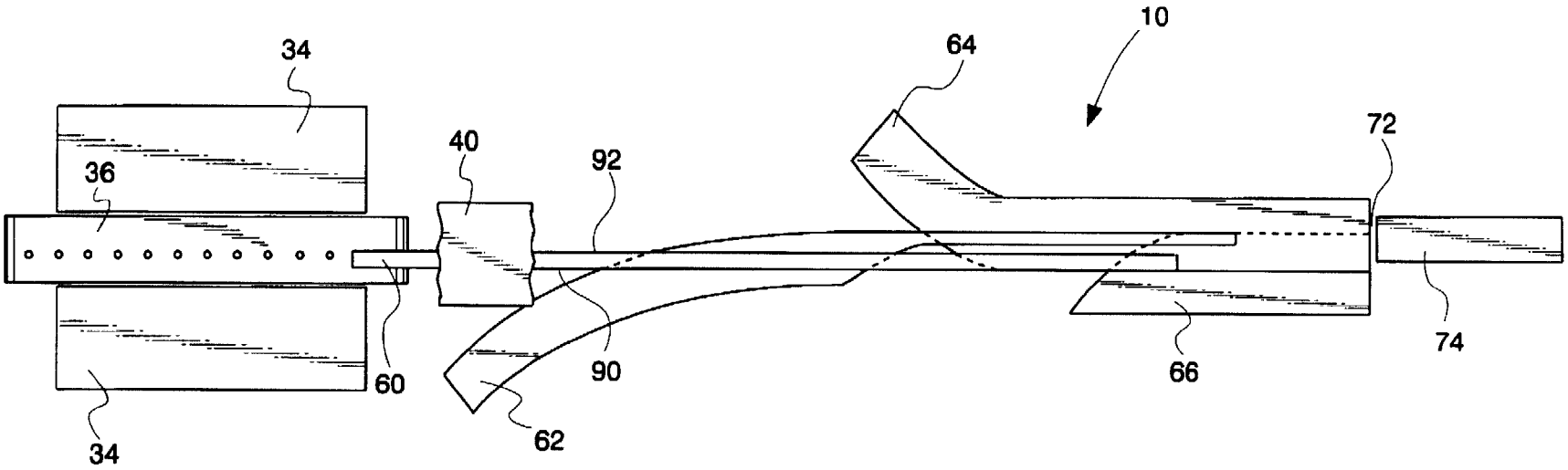
FIG. 12 is a simplified schematic view of FIG. 1 with portions of the balloon-folding machine removed to show the folding plates.
Figure 31:
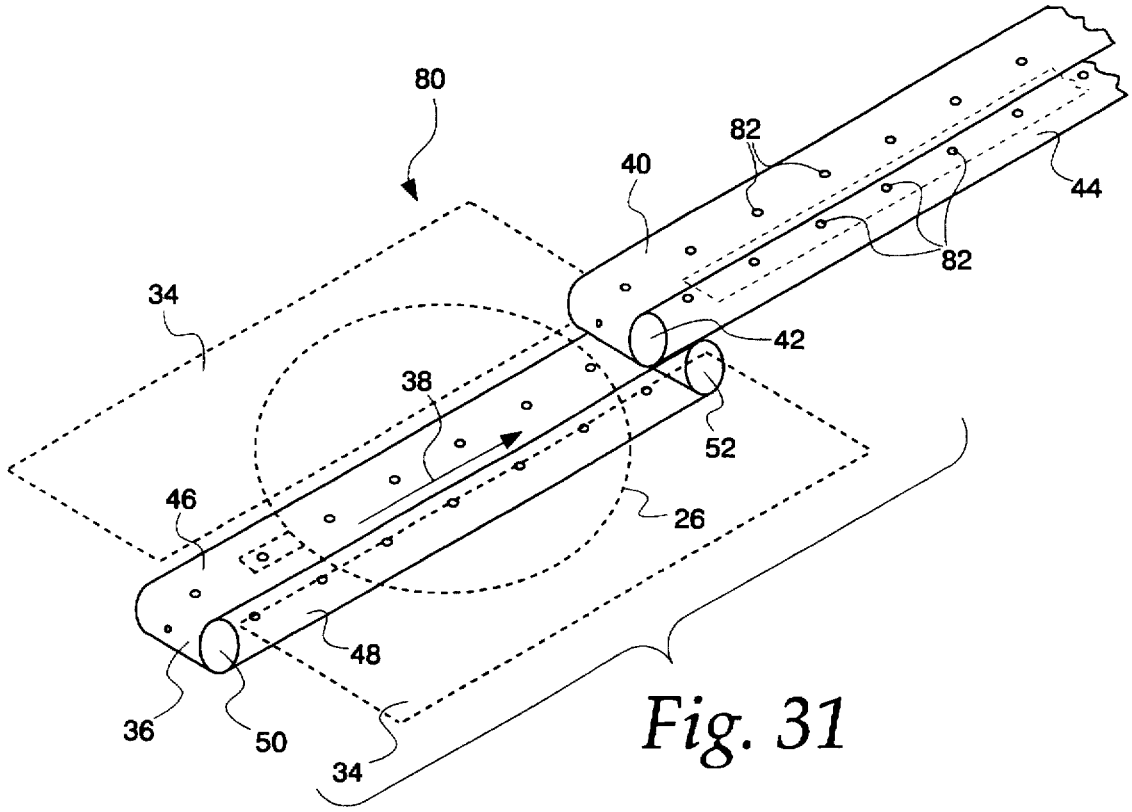
FIG. 31 is a fragmentary perspective view in schematic form of automatic feeding apparatus.
Figure 32:
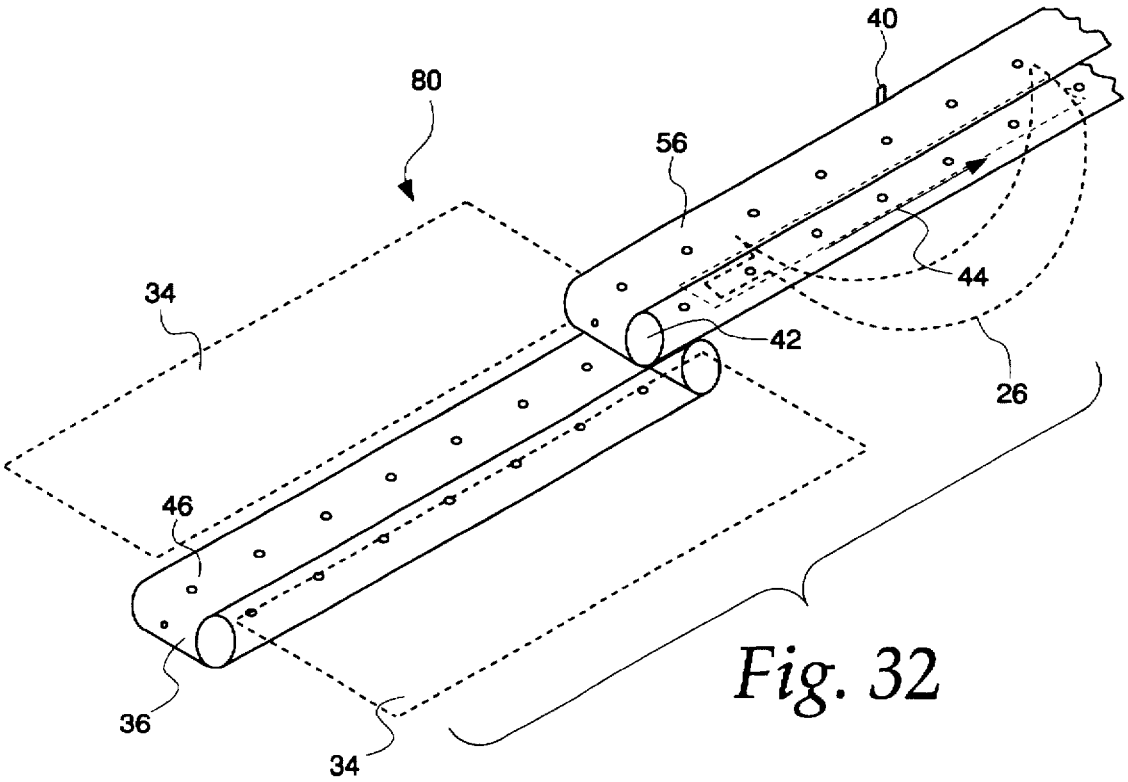
FIG. 32 is a view similar to FIG. 31 but showing a balloon loaded in the machine.

Turning now to FIGS. 1, 31 and 32, a balloon 26 is supported on a table 34 in which a vacuum conveyor 36 is disposed (see FIG. 12). The balloon 26 is placed on table 34 so as to overlie the entry conveyor 36, causing the balloon 26 to initiate travel along a path of manufacture, indicated in FIG. 31 by arrow 38. A main conveyor 40 has an entry roller 42 adjacent the entrance end 12 of the machine. As can be seen in FIGS. 31 and 32, the entry conveyor 36 and main conveyor 40 partly overlap, with the return run 44 of main conveyor belt 40 and the top run 46 of entry conveyor 36 in close proximity to one another so as to form a nip between the two conveyor belts. After passing through the nip, balloon 26 is carried underneath the return run 44 of conveyor belt 40. In the preferred embodiment, balloon 26 is supported from an overlying conveyor which runs continuously along the path of travel as the balloon encounters various folding plates, as will be described.

Figures 13, 14, 15:
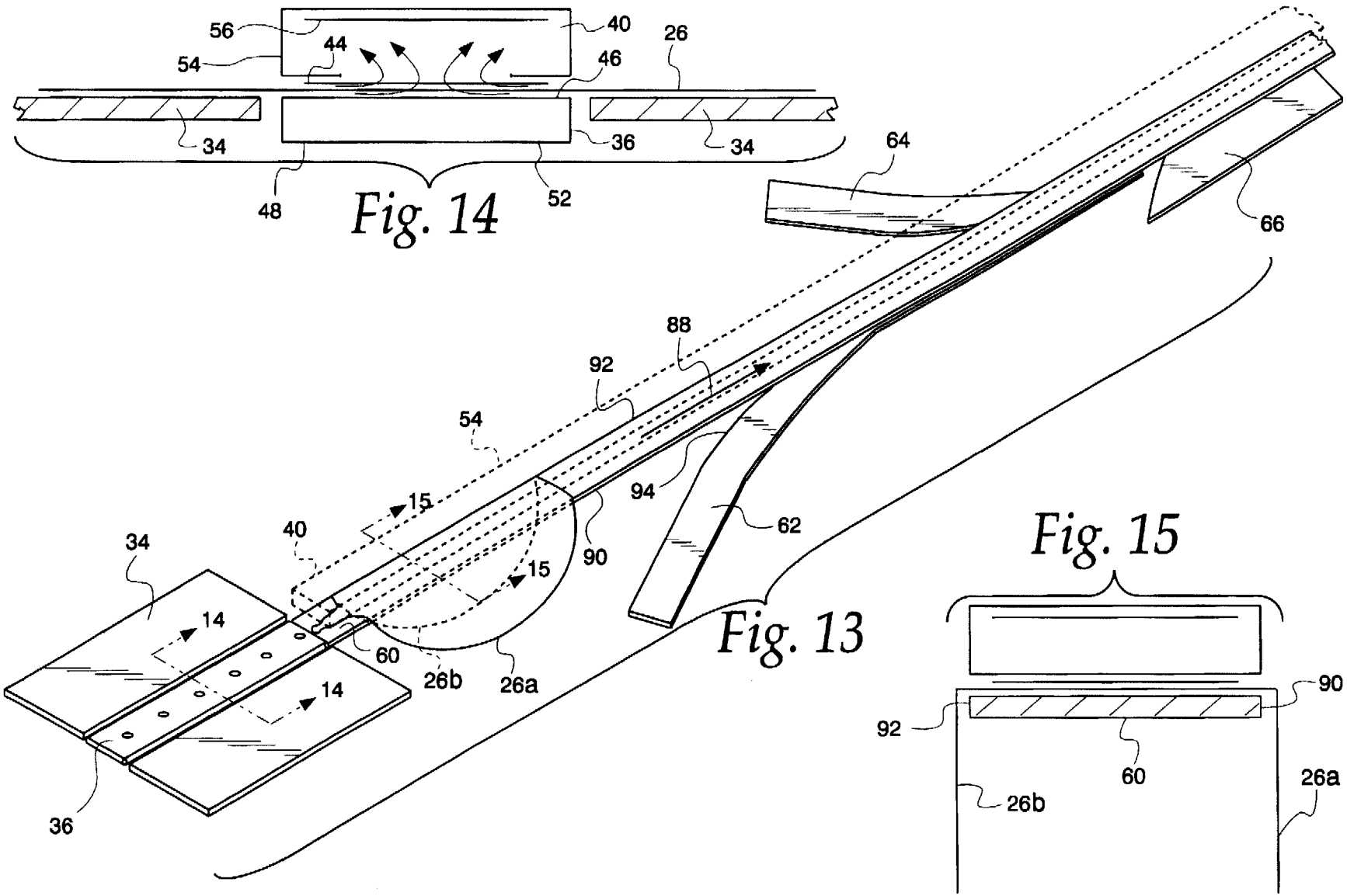
FIG. 13 is a perspective view of FIG. 12.
FIG. 14 is a fragmentary cross-sectional view taken along the line 14—14 of FIG. 13.
FIG. 15 is a cross-sectional view taken along the line 15—15 of FIG. 13.
Figure 16:
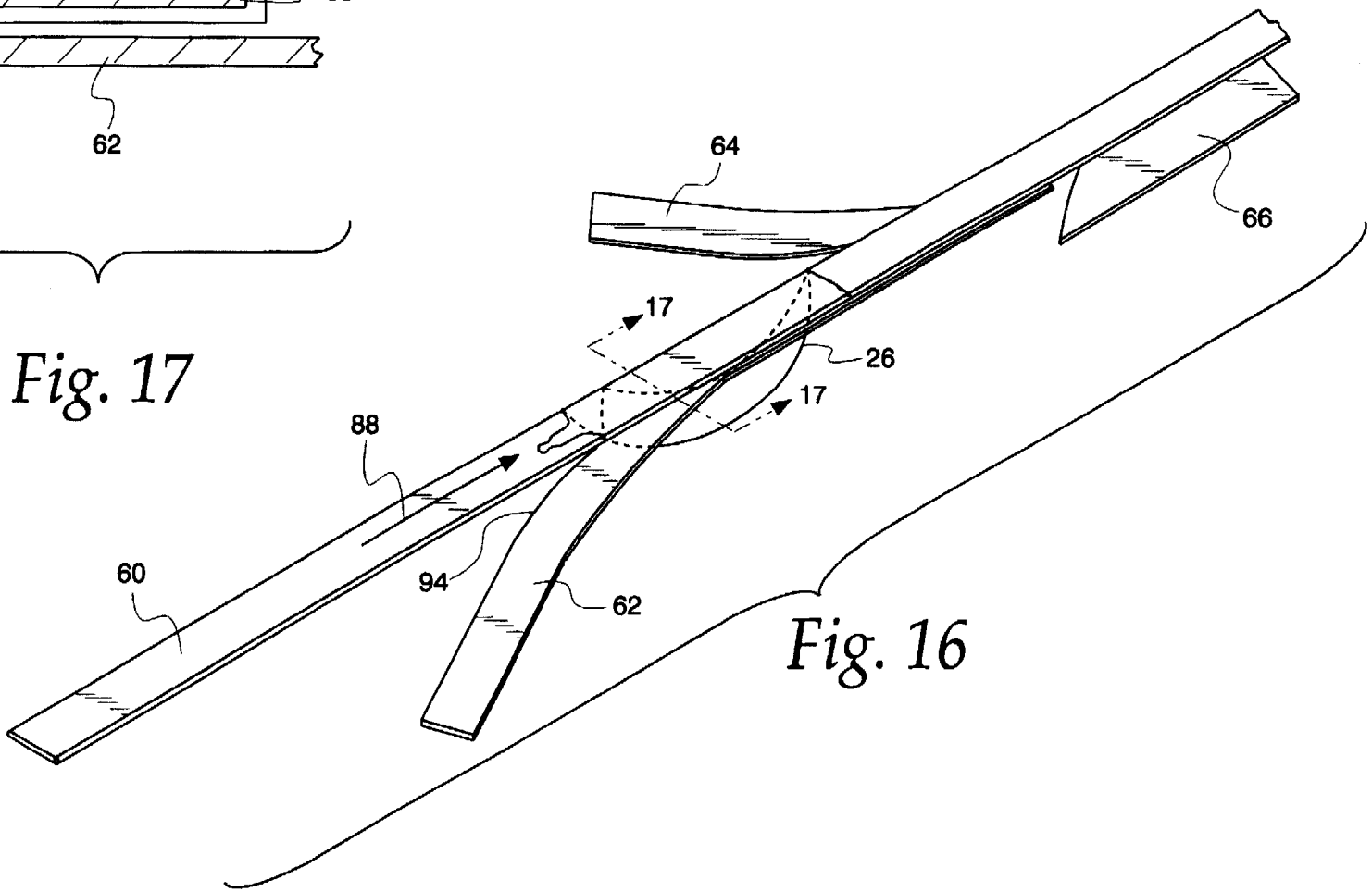
FIG. 16 shows a portion of FIG. 13, indicating a subsequent balloon-folding step.

Referring now to FIGS. 13–15, the conveyor belt 40 is indicated in phantom in FIG. 13 but appears in the cross-sectional view of FIGS. 14 and 15. In FIG. 14, the entry conveyor 36 is shown below balloon 26, inserted between tables 34. The entry conveyor 36 has an upper conveyor run 46, a lower conveyor run 48, and upstream and downstream rollers 50 and 52. A vacuum chamber (not shown) applies a vacuum to the upper conveyor run 46.

The main conveyor 40 is shown in the upper portion of FIG. 14. Main conveyor 40, as mentioned, includes a lower conveyor run 44 located outside of a vacuum housing 54 and an upper conveyor run 56 located within the vacuum housing. The various components shown in FIG. 14 are stretched out in a vertical direction for clarity in the illustration. In the preferred embodiment, the conveyor runs 44, 46, as mentioned above, are placed close together. In the preferred embodiment, the lower run 44 of conveyor 40 is pressed against the bottom surface of vacuum housing 54. As balloon 26 enters the nip between belts 36, 40, balloon 26 is pulled against lower belt run 44, as the lower belt run travels from the entrance of 12 to a point adjacent the exit end 14 of machine 10. The path of travel of the balloon through machine 10 is generally linear, located along the horizontal centerline of the machine, illustrated for example in the top plan view of FIG. 12.

Figure 33:
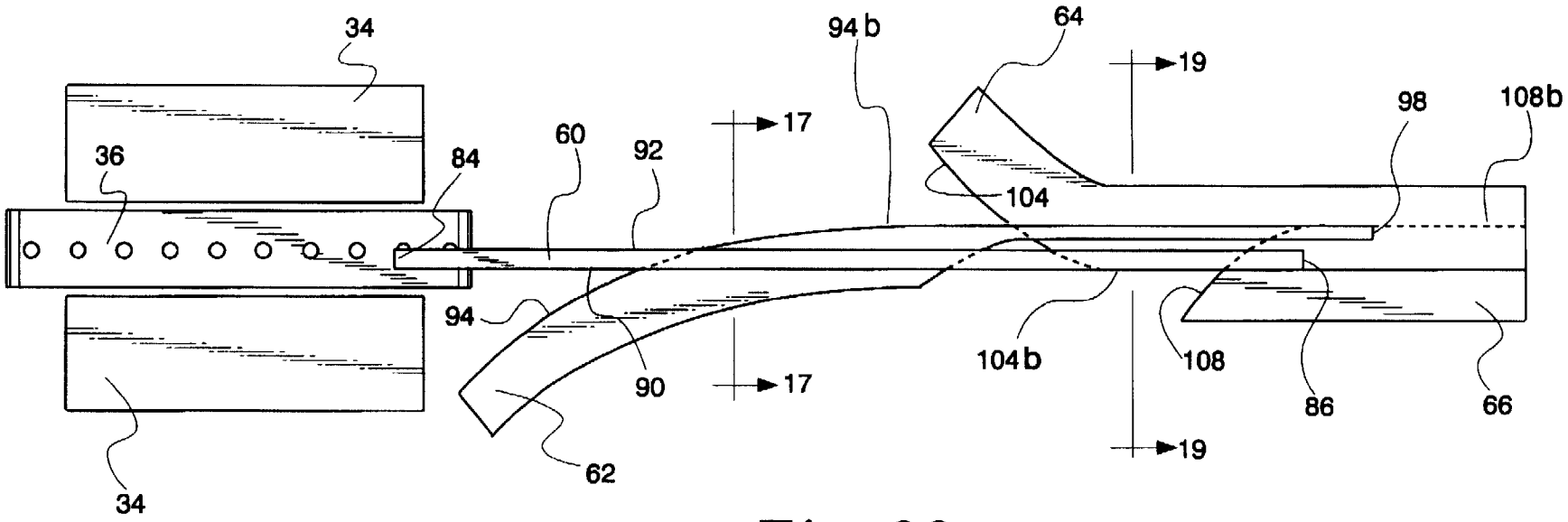
FIG. 33 is a top plan view showing the relative configurations of the folding plates.

Referring now to FIG. 12, a substantial portion of main conveyor 40 has been deleted, in order to better show the plurality of plates which extend throughout the length of machine 10. At the entrance to the machine, an entry plate 60 is located immediately beneath main conveyor 40 and extends along the major portion of the balloon path of travel. Referring additionally to FIG. 33, first, second and third folding plates 62, 64 and 66 are located downstream. As will be seen herein, balloons are carried by main conveyor 40 across working surfaces of the folding plates, while holding the folding plates stationary, thereby causing portions of the balloon to flex along desired fold lines, with portions of the balloon becoming folded one against the other.

Figure 6:
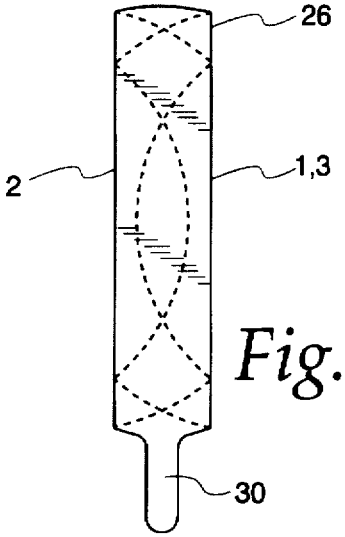
Figure 7:
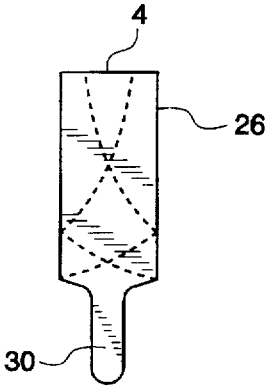
Figure 23:
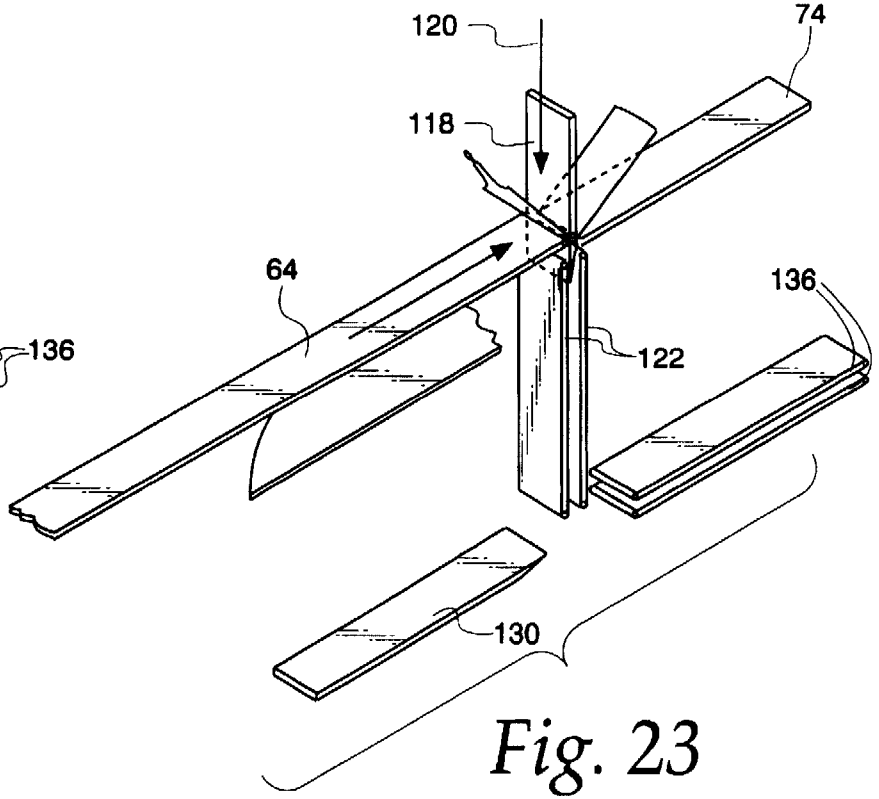
FIGS. 23–28 are views similar to that of FIG. 22, but showing subsequent balloon-folding steps.
Figure 26:
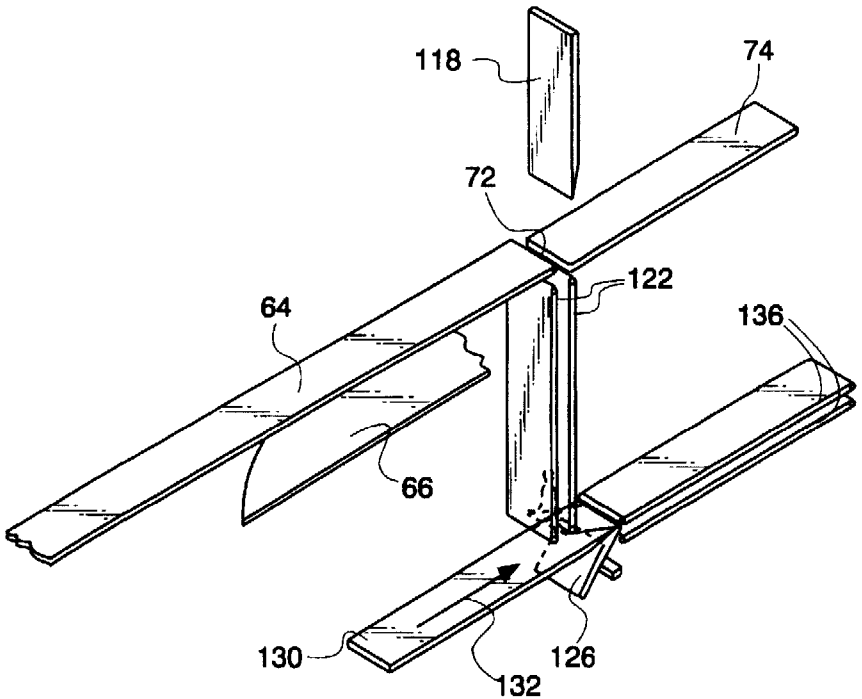

After passing the three folding plates, the balloon takes on the configuration illustrated in FIG. 6. A tucking blade is located atop the gap 72 (illustrated in FIG. 12) formed between the third folding plate 66 and a support plate 74 located adjacent the exit end of machine 10. The tucking blade 118 then pushes the balloon in a transverse direction, as will be explained with reference to FIGS. 22 and 23. This results in a generally rectangular form, as can be in phantom in FIG. 24. A second, horizontally oriented tucking blade further folds the balloon in half, in the manner illustrated in FIG. 26 to produce the final product.

The method and apparatus of the present invention will now be described in greater detail. With reference to FIGS. 1–2 and 31–33, a loading station 80 includes the table 34, entry conveyor 36 and the nip formed between the overlying portions of entry conveyor 36 and main conveyor 40. With additional reference to FIGS. 13 and 14, the table portions 34 have upper surfaces generally aligned with the upper end 46 of the feed conveyor 36, so as to present a substantially continuous support surface for a balloon 26, thereby facilitating the ease with which a balloon may be fed into the folding apparatus.

As will be appreciated by those skilled in the art, typical balloons, especially those of the non-latex type, are flexible and slide easily under the force of gravity. Since adequate support for the balloon is provided at the loading station, an operator's attention may be focused on the desired alignment of the balloon with respect to the apparatus, and in particular the entry conveyor 36. FIG. 1, for example, shows the preferred placement of balloon 26, centered with respect to the entry conveyor 36 (and thereby centered with respect to the main conveyor 40). It is generally preferred that the neck 30 of the balloon be located in a trailing position along the centerline of the entry conveyor, so as to point away from the folding apparatus.

Referring to FIGS. 14 and 31, the chamber 40 is evacuated, so as to apply a vacuum to the openings 82 in main conveyor 40. As can be seen in FIG. 14, vacuum is applied only to the lower run 44 of the main conveyor. Balloon 26 is sucked up against the lower run of main conveyor 40, and travels in the direction indicated in FIG. 31.

Referring to FIG. 13, an entry plate 60 is located immediately below the lower run of main conveyor 40. FIG. 33 shows the entry plate 60 in its entirety, and as can be seen, entry plate 60 has a first end 84 adjacent entry conveyor 36 and a second end 86 partially overlying the third folding plate 66. Although the balloon may be regarded as traveling atop the entry plate 60, the balloon is, in fact, supported from above by vacuum applied to the main conveyor 40.

Under the traction force of main conveyor 40, balloon 26 continues in the downstream direction indicated by arrow 88 in FIG. 13. As indicated in FIG. 13, the support plate 60 is considerably narrower than the lateral width of balloon 26. With reference to FIG. 9, the support plate 60 has a width w, and the distance x corresponds to the lateral distance between fold line 1 and the fold line 2 appearing in the left half of balloon 26. The distance x also corresponds to the distance between laterally-spaced folding edges, as shown in FIG. 9.

With further movement in the direction of arrow 88, the right hand hanging portion 26*a* encounters the working edge 94 of the first folding plate 62. As can be seen in FIG. 33, for example, working edge 94 is continuously curved, especially in that portion of folding plate 62 which intersects the working edge 90 of support plate 60, continuously, through the portion intersecting the second folding plate 64. The cross-sectional view of FIG. 15 shows the right hand hanging portion 26*a* before encountering the working edge 94 of folding plate 62. The hanging portion 26*a* contacts the working edge 94 in gradually, increasing amounts beginning at the leading edge of the balloon, and continuing until the trailing edge (i.e., that edge adjacent balloon stem 30).

Figure 17:
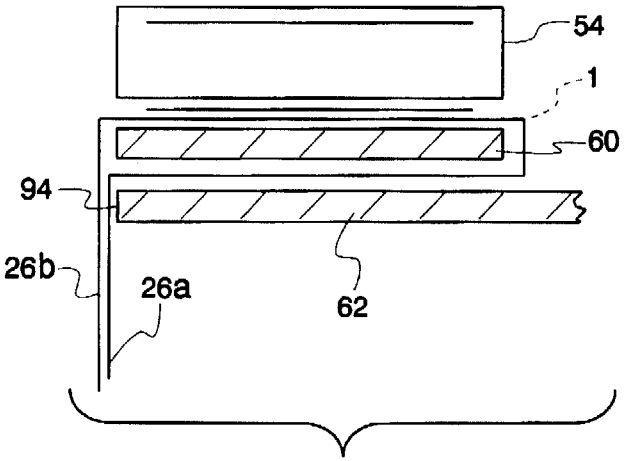
FIG. 17 is a cross-sectional view taken along the line 17—17 of FIG. 16.

As indicated in the cross-sectional view of FIG. 17, the hanging portion 26*a* is folded underneath support plate 60, between support plate 60 and folding plate 62. In a preferred embodiment, a small portion 26*b* is allowed to hang from working edge 94. Referring to FIG. 33, the first folding plate 62 has a working edge portion 94*b* which is generally straight, and continues to the end 98 of the folding plate 62. In the preferred embodiment, end 98 of folding plate 62 extends beyond the end 86 of support plate 60, both ends being disposed to partially overlie the third folding plate 66. The portion 26*b* of the balloon which hangs from working edge portion 94*b* (see FIGS. 17, 19) forms the fold line 2*b* lying in the left half of the balloon shown in FIG. 9.

Figure 18:
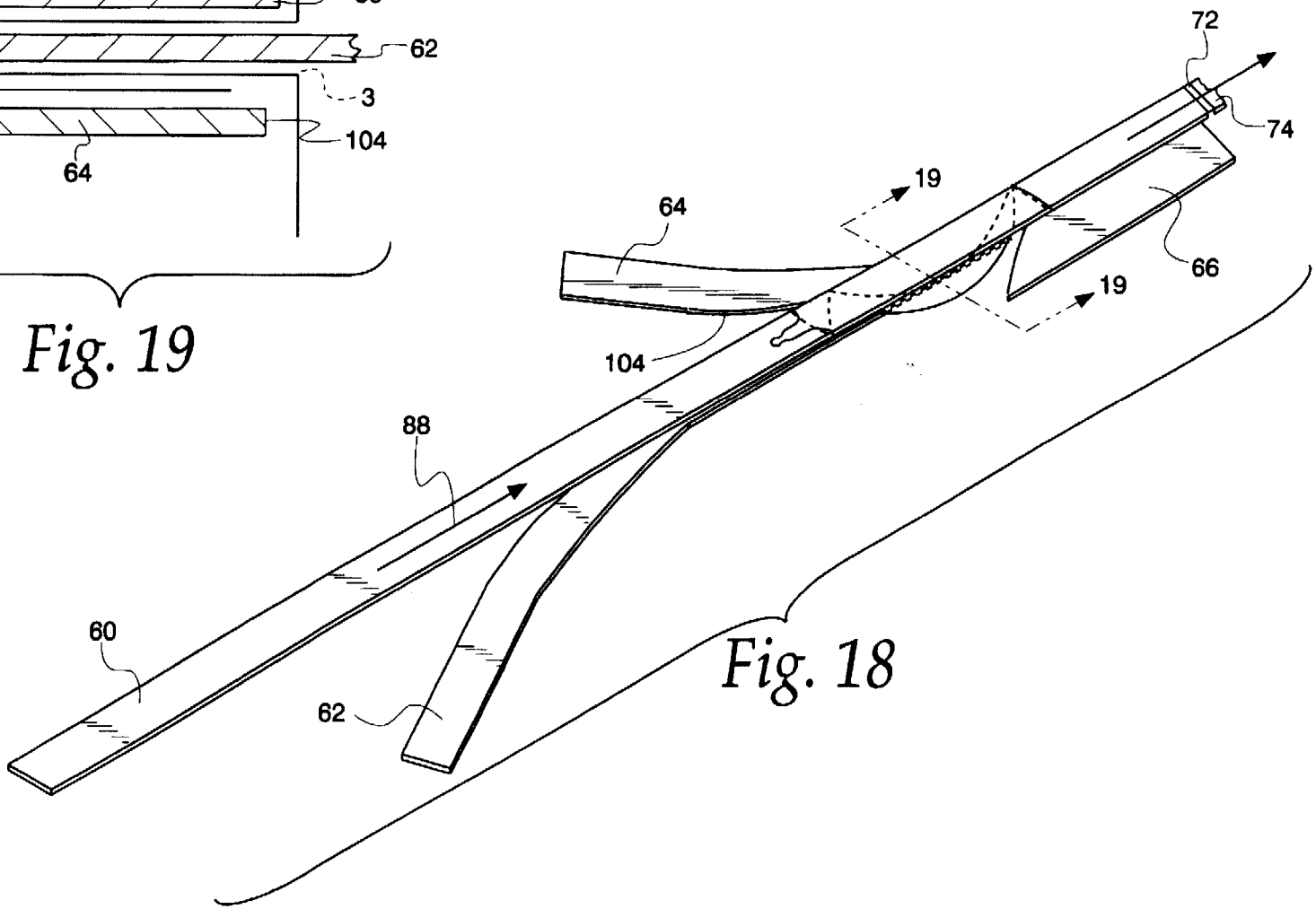
FIG. 18 is a view similar to that of FIG. 16 but showing a later, subsequent balloon-folding step.
Figure 19:
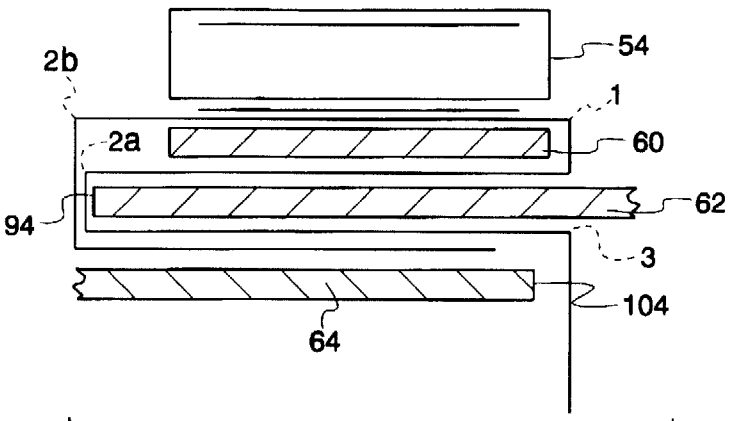
FIG. 19 is an exploded cross-sectional view taken along the line 19—19 of FIG. 18.

Referring now to FIGS. 16–19, the cross-sectional view of FIG. 17 is taken at an intermediate point, prior to the formation of fold lines 2*a*, 2*b* (see FIG. 9). As balloon 26 travels in the downstream direction of arrow 88, the hanging balloon portions 26*a*, 26*b*, shown in FIG. 17, ride along the curved portion of working edge 94 of the first folding plate 62. When the hanging portions of the balloon encounter the straight edge portion 94*b*, they are both located to the left of support plate 60, with working edge 94*b* supporting both hanging portions. Referring to FIGS. 18, 19, with continued travel in the direction of arrow 88, balloon 26 encounterer the working edge 104 of the second folding plate 64. The hanging portions of the balloon contacting the working edge 104 are supported by edge 94*b* of the first folding plate 62. Edge 94*b* serves as a holding surface, defining a supporting edge against which hanging portions of the balloon are gently pulled as they contact the working edge 104 of the second folding plate 64. As with the first folding plate 62, the working edge of the second folding plate 64 is gradually blended into a straight edge 104*b* (see FIG. 33) extending in the direction of travel of the balloon.

Figure 20:
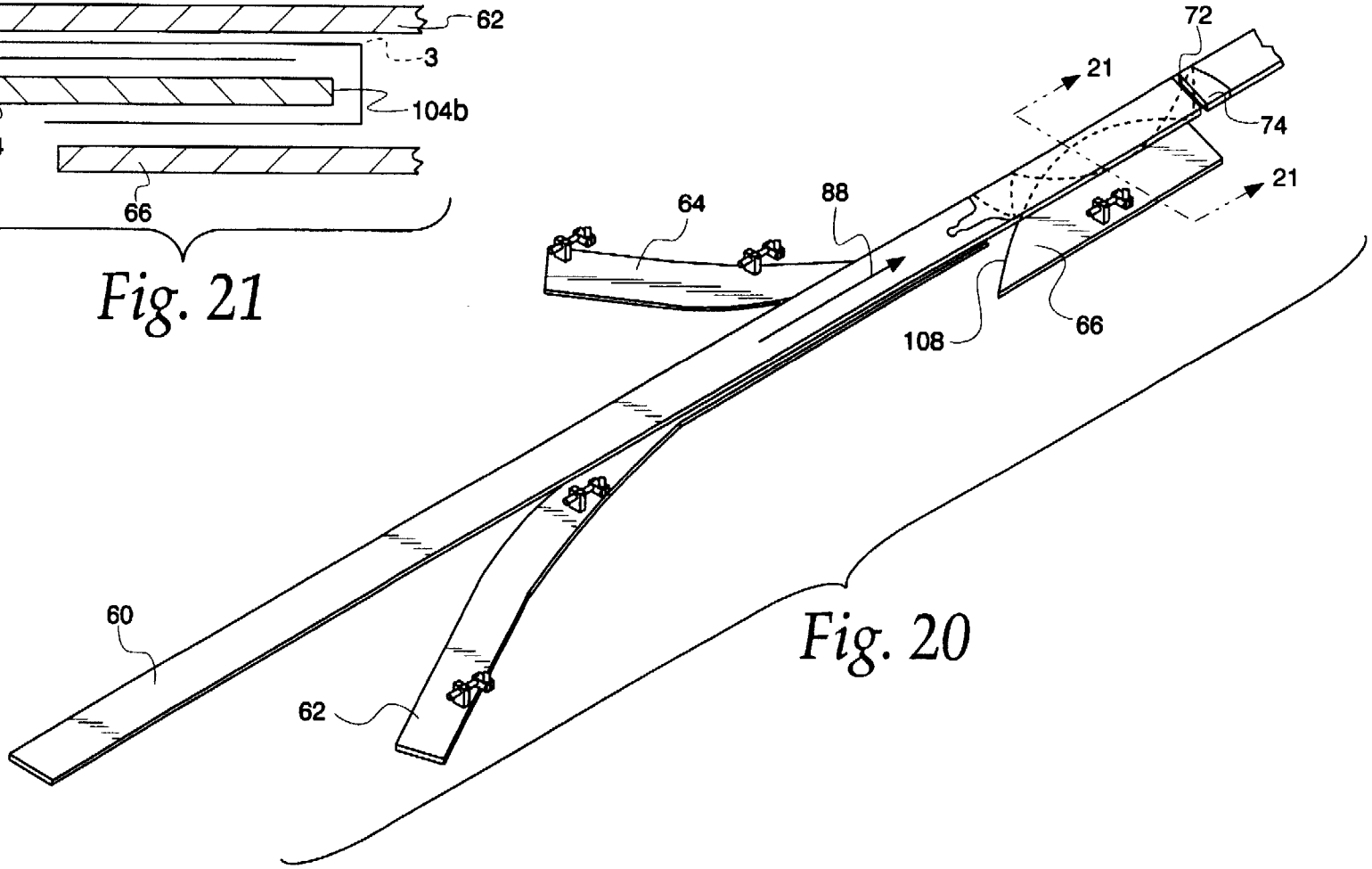
FIG. 20 is a view similar to that of FIG. 18 showing a subsequent balloon-folding step.
Figure 21:
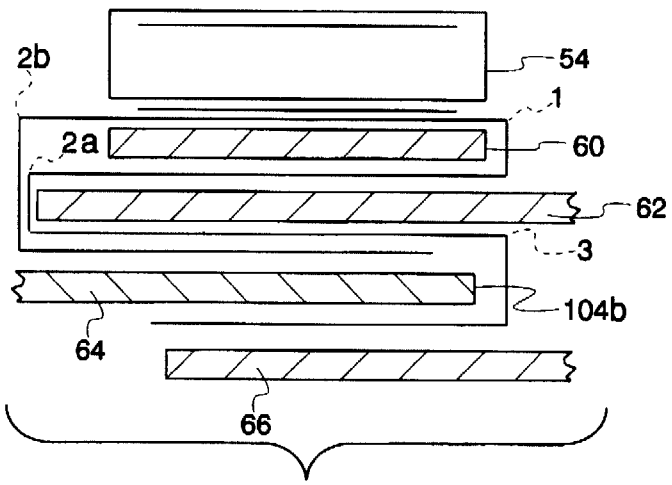
FIG. 21 is an exploded cross-sectional view taken along the line 21—21 of FIG. 20.

The edge portion 104*b* of the second folding plate 64 serves as a folding edge for resisting the gentle pull as the balloon encounters the working edge 108 of the third folding plate 66 (see FIG. 20). Referring to FIG. 33, the working edge 108 is gradually blended into a straight edge 108*b* extending in the direction of travel of the balloon. This forms the fold line 3, as indicated schematically, in FIG. 21. This complete the side-to-side folding of the balloon.

Figure 22:
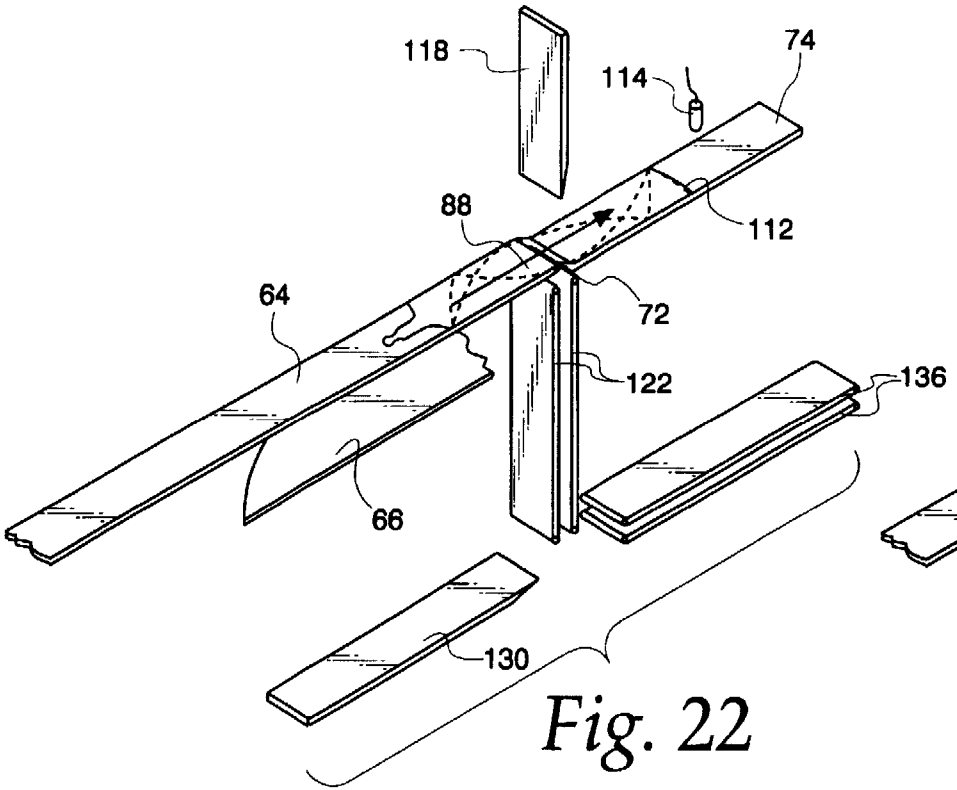
FIG. 22 is a fragmentary perspective view of the balloon-folding machine, shown as a continuation of FIG. 20.

With reference to FIGS. 22–28, length-wise folding of the balloon is accomplished in several steps. Referring initially to FIG. 22, the balloon is transported in a direction of arrow 88, passing over the gap 72 formed between the folding plates 64, 66 and support plate 74. At this point, the balloon is folded generally in the form of a rectangle traveling in the direction of arrow 88. The leading edge 112 of the balloon is detected by sensor 114 (shown in FIG. 22) which sends a command to activate the tucking blade 118. It is generally preferred that the vacuum conveyor be terminated adjacent the gap 72, and the leading end of the balloon, stiffened by the several folds, is readily "pushed" along support plate 74. With the center portion of the balloon aligned at gap 72, a first tucking blade 118 is lowered in the direction of arrow 120 shown in FIG. 23 to fold the balloon in half in the manner indicated.

Figure 25:
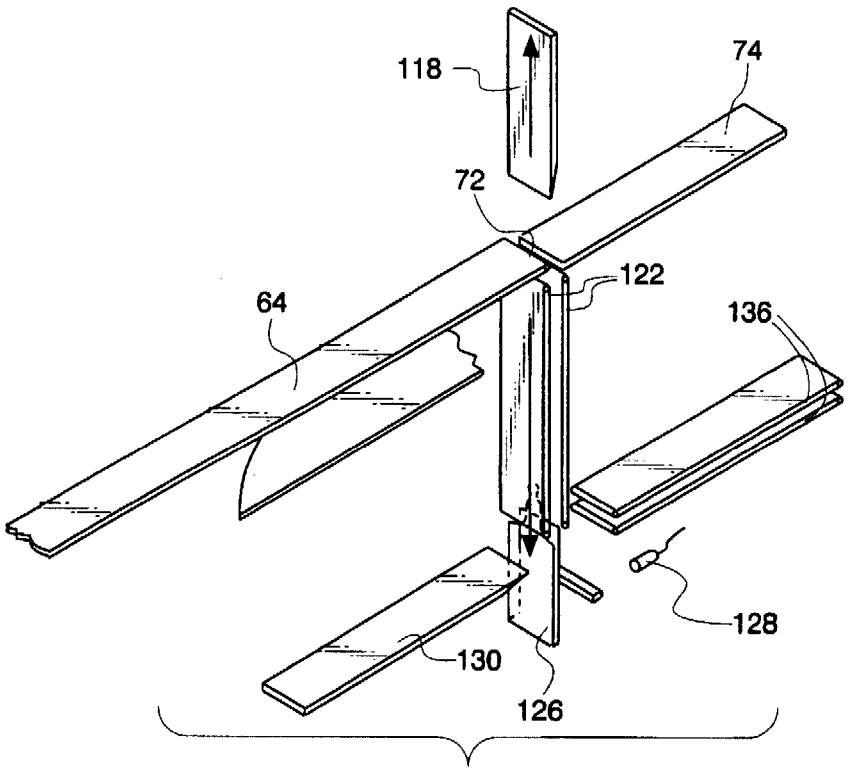
Figure 24:
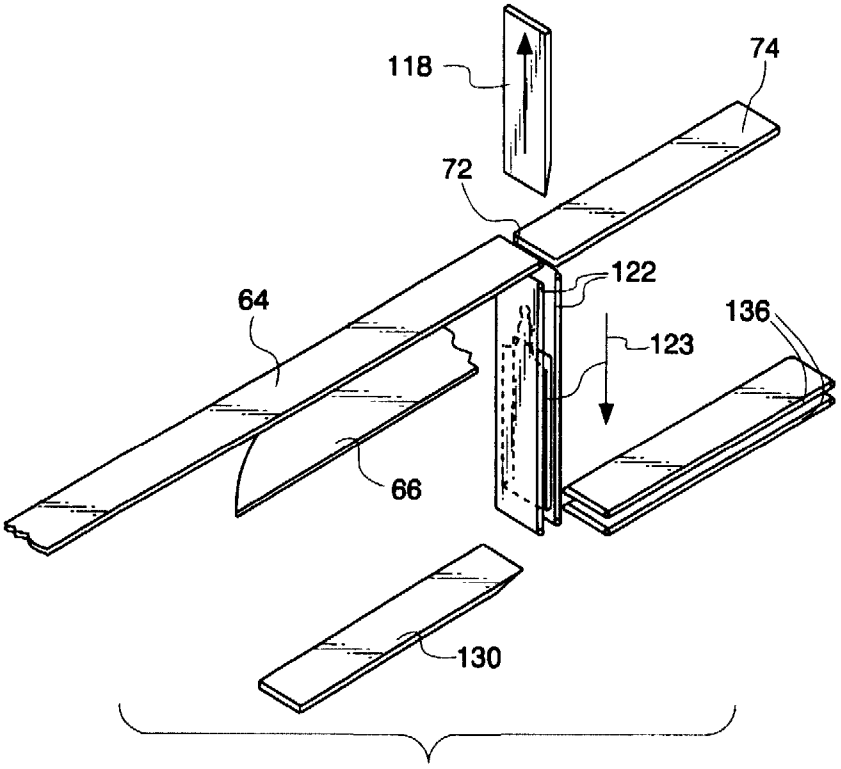
Figure 27:
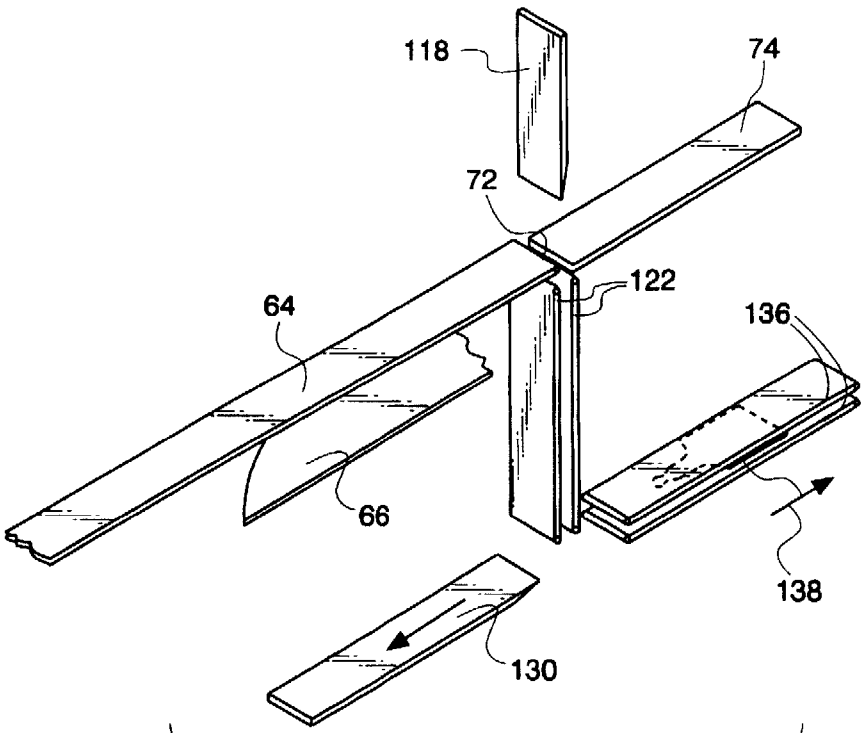
Figure 28:
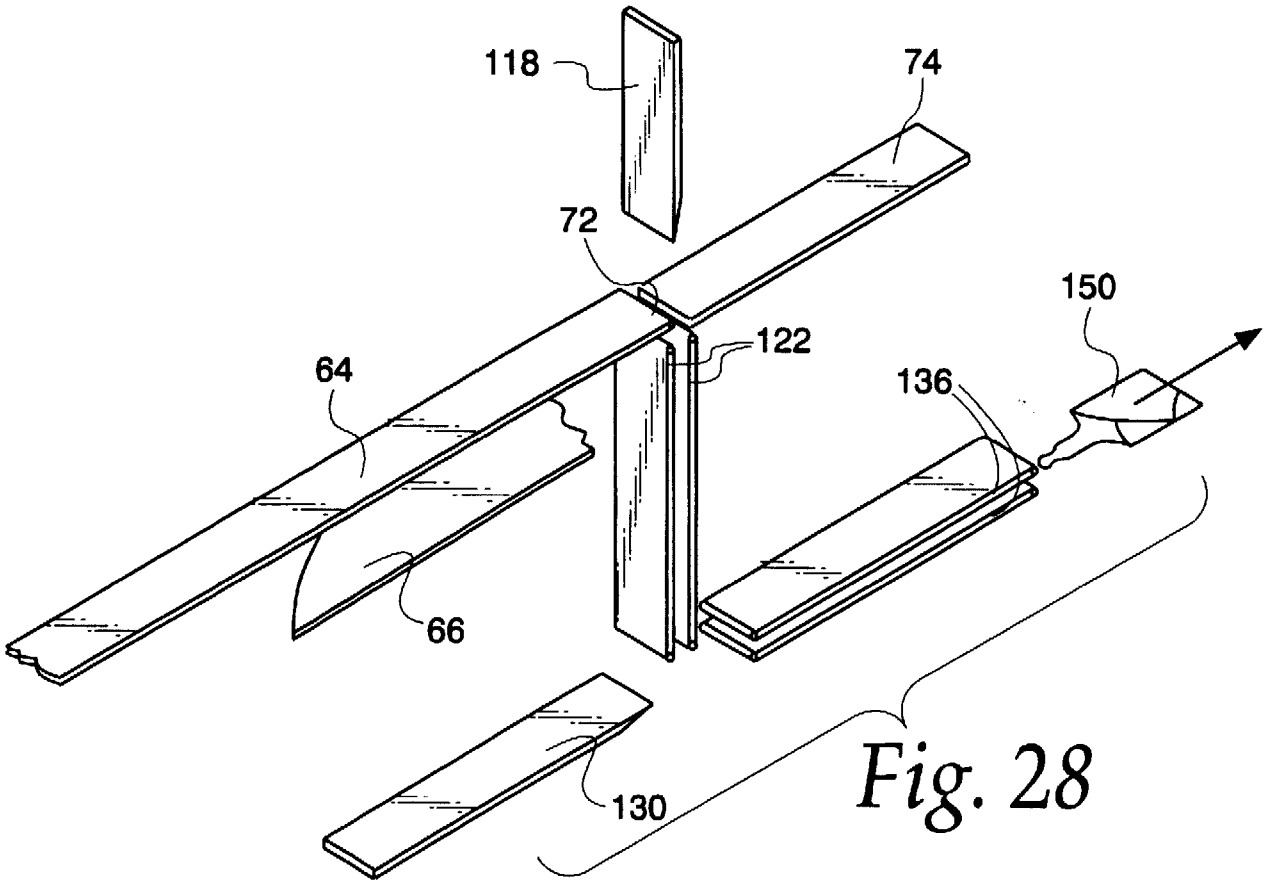

The tucking blade stuffs the balloon between a pair of conveyor belts 122 to move the balloon in the downward direction of arrow 123, as shown in FIG. 24. Referring to FIG. 25, the leading edge 126 of the balloon is detected by sensor 128, which activates a second tucking blade 130 to move in the direction of arrow 132 of FIG. 26. The tucking blade 132 thereby stuffs the balloon between conveyor belts 136 with the balloon traveling in a direction of arrow 138, as shown in FIG. 27. The folded balloon product 150 then exits the folding apparatus, as shown in FIG. 28, ready for packaging and shipment to a remote location, or to further product-finishing stations.

Figure 29:
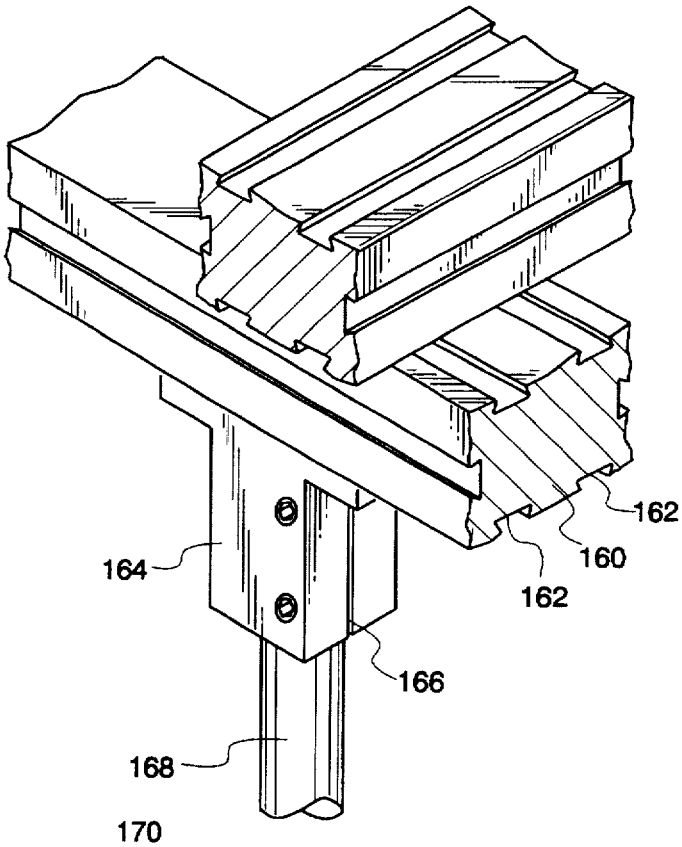
FIG. 29 is a fragmentary perspective view of apparatus for suspending the folding plates.
Figure 29:
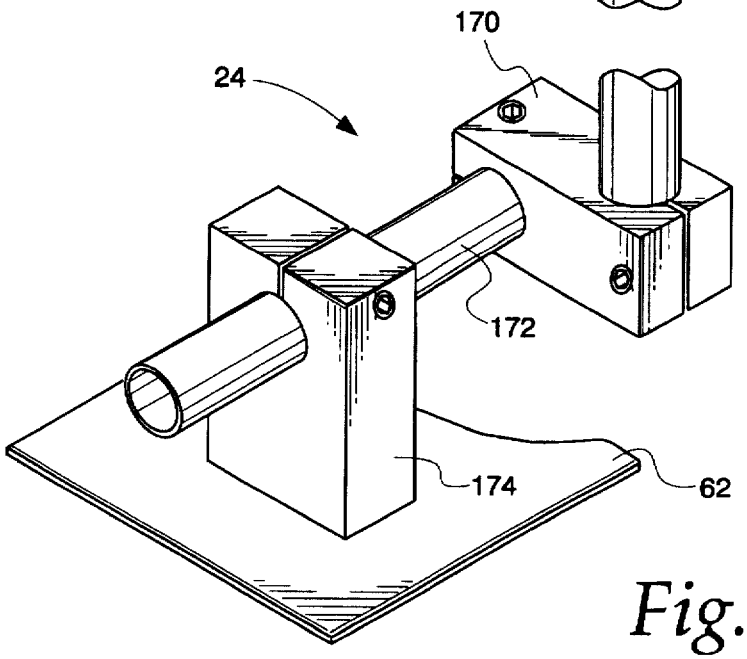

The folding apparatus is readily reconfigurable for different size and shape balloons. With reference to FIG. 29, an adjustable hanger 24 is hung from a lateral support rail 160 which extends crosswise across framework 22, as shown in FIG. 1. The cross-rails 160 are slotted at 162 to receive a sliding head 164. The sliding head 164 is slit at 166 to receive a support cylinder 168, which in turn is received in a split mounting block 170. Mounting block 170 in turn supports cylinder 172 received in a split mounting block 174 mounted to folding plate 62. A plurality of adjustable hangers 24 are provided for the folding apparatus, as can be seen in FIG. 1. According to principles of the present invention, only two adjustable supporting hangers are needed for each folding plate. Although more adjustable hangers could be provided, if desired, only two adjustable hangers have been found necessary to orient the folding plates in various positions needed to accommodate a wide range of commercially important toy balloon products. As indicated in the various figures, each succeeding folding place is located beneath the former folding plate, in order to provide a smooth transition for the flexible balloon film, as it travels between entrance and exit ends of the folding apparatus.

Figure 34:
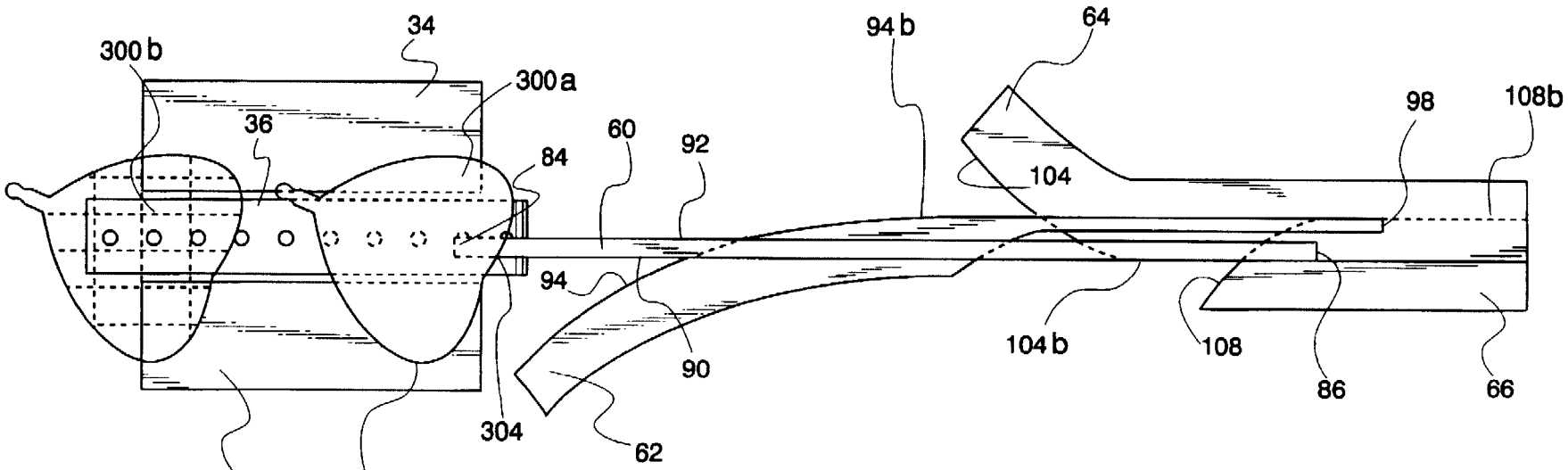
FIG. 34 is a top plan view showing a desired orientation of an irregular shaped balloon with the folding apparatus.

Turning now to FIG. 34, a balloon 300*a* having an outer periphery 302 is positioned on the folding apparatus 10. As can be seen in the Figure, the balloon periphery has an irregular shape resembling a heart. The balloon is positioned at an angle to the centerline of the machine, as indicated in FIG. 34, so that a generally concave portion 304 is presented to the first folding blade. With the arrangement shown in FIG. 34, the generally concave edge portion 304 forms an acute angle with the working edge of the first folding plate (i.e., the edge portion of the folding plate which first contacts a balloon). In FIG. 34, balloon 300*b* has been laid at the entrance end of the machine after being folded, and subsequently unfolded to show a comparison with the balloon 300*a*.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. An apparatus for folding a flexible, inflatable vessel comprised of a toy balloon having at least two balloon films joined together at respective peripheral edges to form a first portion and remaining portions, said first portion having an upper surface, the apparatus comprising:

a conveyor means having an inlet end and an outlet end, for lifting and pulling the upper surface of the first portion of the inflatable vessel and for hangingly suspending the remaining portions of the inflatable vessel while lifting, pulling and hangingly suspending the inflatable vessel along a path of travel;

a serial succession of generally horizontal folding plates at least partly disposed below the conveyor means and having laterally offset inlet edges disposed at an angle to the path of travel and spaced apart along the path of travel; and such that the conveyor means lifts and pulls the inflatable vessel over and past the inlet edges of the folding plates so as to slide the remaining, hangingly suspended portions in overlying relationship with the inlet edges of the folding plates, folding successive parts of the remaining, hangingly suspended portions in overlying relationship with one another and with the first portion.

2. The apparatus of claim 1 wherein said folding plates are partly overlying.

3. The apparatus of claim 1 wherein said folding plates further include other, straight line portions extending along the path, downstream of the outlet edges of the folding plates.

4. The apparatus of claim 1 wherein each successive folding plate arranged along the path of travel is disposed below preceding folding plates.

5. The apparatus of claim 4 wherein said plates are partly overlying.

6. The apparatus of claim 1 wherein the inlet edges are curved.

7. The apparatus of claim 6 wherein said inlet edges are part circular.

8. The apparatus of claim 1 wherein said conveyor applies a vacuum to the upper surface of said inflatable vessel.

9. The apparatus of claim 8 further comprising a tucking blade adjacent the outlet end of the conveyor means and movable across the path of travel to engage the folded balloon, folding the balloon into further folded overlying portions.

10. The apparatus of claim 9 further comprising a second tucking blade below the first tucking blade, movable in a direction generally perpendicular to the first tucking blade, folding the inflatable vessel into additional folded, overlying portions.

11. The apparatus of claim 1 wherein said folding plates comprise first, second and third folding plates with inlet edges sequentially arranged along the path of travel with the first and third plates disposed to one side of the path of travel, and the second plate disposed along an opposite side of the path of travel.

12. The apparatus of claim 1 further comprising an infeed conveyor located partly beneath said conveyor means, said infeed conveyor applying a vacuum to a portion of said inflatable vessel and aligned with the path of travel so as to pass underneath said conveyor means.

13. The apparatus of claim 12 further comprising a support table disposed adjacent said infeed conveyor and cooperating with said infeed conveyor to support substantially an entire portion of said inflatable vessel on a common support plane.

14. The apparatus of claim 13 wherein such common support plane, said conveyor means and said path of travel are substantially horizontally positioned.

15. A method for folding a toy balloon comprising at least two balloon films joined together at respective peripheral edges to form a pressure-containing vessel having a first portion and remaining portion, said first portion having an upper surface, comprising the steps of:

providing a conveyor means extending along a path of travel, the conveyor means having an inlet end and an outlet end;

lifting the upper surface of the first portion of the toy balloon, and hangingly suspending the remaining portions of the toy balloon while lifting, pulling and hangingly suspending the toy balloon along the path of travel;

providing at least one folding plate having an inlet edge with a working edge portion; and disposing the at least one folding plate along the path of travel, at least partly below the conveyor means and at an angle to the conveyor means; and pulling the toy balloon over and past the folding plate so as to slide the remaining, hangingly suspended portions of the toy balloon in overlying relationship with the inlet edge of the folding plate, deflecting the remaining, hangingly suspended portions of the toy balloon between the folding plate and the conveyor means, and folding the remaining hangingly suspended portions of the toy balloon in overlying relationship with the first portion of the toy balloon.

16. The method of claim 15 further comprising the steps of:

providing a tucking blade;

positioning the tucking blade adjacent the outlet end, to one side of the path of travel; and moving the tucking blade across the path of travel to fold the balloon into further folded, overlying portions.

17. The method of claim 16 further comprising the steps of:

providing a second conveyor means extending below the path of travel so as to receive the further folded, overlying portions from the tucking blade, the second conveyor means conveying the balloon along a second path of travel;

providing a second tucking blade;

positioning the tucking blade to one side of the second path of travel; and moving the tucking blade across the second path of travel to fold the balloon into additional folded, overlying portions.

18. The method of claim 15 further comprising the steps of:

providing a second folding plate having an inlet edge;

disposing the second folding plate in serial succession with said at least one folding plate along the path of travel, downstream of the at least one folding plate, at least partly below the conveyor means and at an angle to the conveyor means; and conveying the toy balloon past the second folding plate so as to slide part of the second portion of the toy balloon in overlying relationship with the inlet edge of the second folding plate, deflecting the part of the second portion of the toy balloon between the second folding plate and the conveyor means, and folding the part of the second portion of the toy balloon in overlying relationship with the first portion of the toy balloon.

19. The method of claim 18 further comprising the steps of:

providing a tucking blade;

positioning the tucking blade adjacent the outlet end, downstream of the second folding plate, to one side of the path of travel; and moving the tucking blade across the path of travel to fold the balloon into further folded, overlying portions.

20. The method of claim 19 further comprising the steps of:

providing a second conveyor means downstream of the second folding plate and extending below the path of travel so as to receive the further folded, overlying portions from the tucking blade, the second conveyor means conveying the balloon along a second path of travel;

providing a second tucking blade;

positioning the tucking blade to one side of the second path of travel; and moving the tucking blade across the second path of travel to fold the balloon into additional folded, overlying portions.

21. The method of claim 15 further comprising the step of providing an infeed conveyor means;

disposing said infeed conveyor means partly underneath said conveyor means;

supporting substantially an entire portion of said toy balloon on a common plane in which the infeed conveyor is positioned; and aligning the conveyor means and path of travel with the common plane.

* * * * *